US006329950B1

(12) United States Patent
Harrell et al.

(10) Patent No.: US 6,329,950 B1
(45) Date of Patent: Dec. 11, 2001

(54) PLANAR ANTENNA COMPRISING TWO JOINED CONDUCTING REGIONS WITH COAX

(75) Inventors: Daniel W Harrell, Bellingham, WA (US); Pamela R Wallace, Lost Creek, WV (US)

(73) Assignee: Integral Technologies, Inc., Bellingham, WA (US)

( * ) Notice: Subject to any disclaimer, the term of this patent is extended or adjusted under 35 U.S.C. 154(b) by 0 days.

(21) Appl. No.: 09/730,711

(22) Filed: Dec. 6, 2000

Related U.S. Application Data

(60) Provisional application No. 60/168,732, filed on Dec. 6, 1999.

(51) Int. Cl.[7] ..... H01Q 1/48

(52) U.S. Cl. ..... 343/700 MS; 343/713; 343/769

(58) Field of Search ..... 343/700 MS, 745, 343/767–769, 713, 711, 770, 789

(56) References Cited

U.S. PATENT DOCUMENTS

| | | | |
|---|---|---|---|
| 4,038,662 | 7/1977 | Turner | 343/752 |
| 4,410,891 | 10/1983 | Schaubert et al. | 343/700 MS |
| 4,509,209 | 4/1985 | Itoh et al. | 455/327 |
| 4,559,539 | 12/1985 | Markowitz et al. | 343/725 |
| 4,987,421 | 1/1991 | Sunahara et al. | 343/700 MS |
| 4,987,424 | 1/1991 | Tamura et al. | 343/795 |
| 5,124,714 | 6/1992 | Harada | 343/713 |
| 5,363,114 | 11/1994 | Shoemaker | 343/828 |
| 5,371,507 | 12/1994 | Kuroda et al. | 343/700 MS |
| 5,649,350 | 7/1997 | Lampe et al. | 29/600 |
| 5,714,961 | 2/1998 | Kot et al. | 343/769 |
| 5,995,058 * | 11/1999 | Legay et al. | 343/789 |
| 6,097,345 * | 8/2000 | Walton | 343/769 |
| 6,121,930 * | 9/2000 | Grangeat et al. | 343/700 MS |

* cited by examiner

*Primary Examiner*—Don Wong
*Assistant Examiner*—James Clinger
(74) *Attorney, Agent, or Firm*—George O. Saile; Stephen B. Ackerman; Larry J. Prescott

(57) ABSTRACT

An antenna is formed from two antenna elements, a first antenna element and a second antenna element, wherein the second antenna element surrounds the first antenna element. A shorting element electrically connects the inner antenna element to the outer antenna element. An insulating gap insulates the inner antenna element from the outer antenna element except for the region where the shorting element connects the two antenna elements. A coaxial cable connects the antenna to a transceiver. The inner conductor of the coaxial cable is connected to the first antenna element and the outer conductor of the coaxial cable is connected to the second antenna element. The length of the outer perimeter of the first antenna element is equal to an integral multiple of one quarter of the wavelength of the center frequency of the antenna. The inner antenna element can be rectangular, square, circular, oval, or any similar shape. More than one antenna can be formed on a single layer of dielectric material. The impedance of the antenna is tuned by adjusting the location of the shorting element, the location of the connection of the inner conductor of the coaxial cable to the first antenna element, and the location at which the coaxial cable exits the second antenna element.

28 Claims, 6 Drawing Sheets

PLANAR ANTENNA COMPRISING TWO JOINED CONDUCTING REGIONS WITH COAX

This Patent Application is based on a Provisional Patent Application, filed Dec. 6, 1999, Serial No. 60/168,732, entitled "'DAHA' ANTENNA (PLANAR GEOMETRIC SLOT ANTENNA)", by the same Inventors.

BACKGROUND OF THE INVENTION (1) Field of the Invention

This invention relates to planar antennas formed by etching patterns in a layer of conducting material formed on a layer of dielectric material. A coaxial cable is used to connect the antenna to a transceiver and is also used to aid in the tuning of the antenna. The antennas are either transmitting or receiving antennas.

(2) Description of the Related Art

U.S. Pat. No. 5,714,961 to Kot et al. describes a directional planar antenna having a number of coaxial ring-slot radiating elements.

U.S. Pat. No. 4,559,539 to Markowitz et al. describes a spiral antenna deformed to receive another antenna.

U.S. Pat. No. 5,363,114 to Shoemaker describes planar serpentine antennas.

U.S. Pat. No. 4,509,209 to Itoh et al. describes an integrated planar antenna-mixer device for microwave reception. A diode quad is connected to the antenna.

U.S. Pat. No. 5,124,714 to Harada describes a planar antenna for automobiles.

U.S. Pat. No. 4,410,891 to Schaubert et al. describes a polarized micro-strip antenna. The polarization can be changed from vertical linear to horizontal linear, left circular, right circular or and desired elliptical sense.

U.S. Pat. No. 5,371,507 to Kuroda et al. describes a planar antenna comprising a ground conductor, a dielectric layer laminated on the ground conductor, and a radiation element laminated on the dielectric layer.

U.S. Pat. No. 4,987,421 to Sunahara et al. describes a micro-strip antenna having an annular radiation conductor with a central opening.

U.S. Pat. No. 4,038,662 to Turner describes a broadband antenna in the form of a multiple element interlaced dipole array mounted on a thin elongated strip of dielectric material.

U.S. Pat. No. 5,649,350 to Lampe et al. describes a method of mass producing printed circuit antennas.

U.S. Pat. No. 4,987,424 to Tamura et al. describes an antenna apparatus having flexible antennas made of conductive material on a flexible insulating sheet.

SUMMARY OF THE INVENTION

Antennas are an essential part of electronic communication systems that contain wireless links. Low cost, low profile antennas that can operate either as transmitting or receiving antennas and can be used over non-conducting or conducting surfaces are important to a number of communication applications.

It is a principle objective of this invention to provide a planar antenna having first and second antenna elements formed of conducting material on a layer of dielectric material and using a length of coaxial cable as both a transmission aid and a tuning mechanism.

It is another principle objective of this invention to provide a planar antenna having first and second antenna elements formed of conducting material on a layer of dielectric material and surrounded by a background element of conducting material formed on a layer of dielectric material.

It is another principle objective of this invention to provide multiple planar antennas, each antenna having first and second antenna elements formed of conducting material on a layer of dielectric material.

These objectives are achieved by patterning a layer of conducting material formed on a layer of dielectric material in order to form antenna elements. An antenna is formed from two such antenna elements, a first antenna element and a second antenna element, wherein the second antenna element surrounds the first antenna element. A shorting element electrically connects the first antenna element to the second antenna element. An insulating gap insulates the first antenna element from the second antenna element except for the region where the shorting element connects the two antenna elements. A length of coaxial cable having a predetermined fixed length is used to tune the antenna elements relative to each other and to the desired frequency, and to provide additional gain through the radiation of the coaxial cable that is attached directly to the antenna elements.

A coaxial cable having an inner conductor and an outer conductor connects the antenna to a transceiver, wherein the inner conductor of the coaxial cable is connected to the first antenna element and the outer conductor of said coaxial cable is connected to the second antenna element. The length of the outer perimeter of the first antenna element is equal to an integer multiple of one quarter of the wavelength of the center resonance frequency of the antenna. The coaxial cable is placed around the perimeter of the second antenna element and exited from the antenna surface at a total coaxial cable length of an integer number of one-half wavelengths of the center frequency of the antenna.

The first antenna element can be rectangular, square, circular, oval, or any similar shape having an outer perimeter length equal to an integer multiple of one quarter of the wavelength of the center frequency of the antenna. Two or more antennas can be formed on the same layer of dielectric material each having the same or a different center frequency.

DESCRIPTION OF THE PREFERRED EMBODIMENTS

Figure 1:
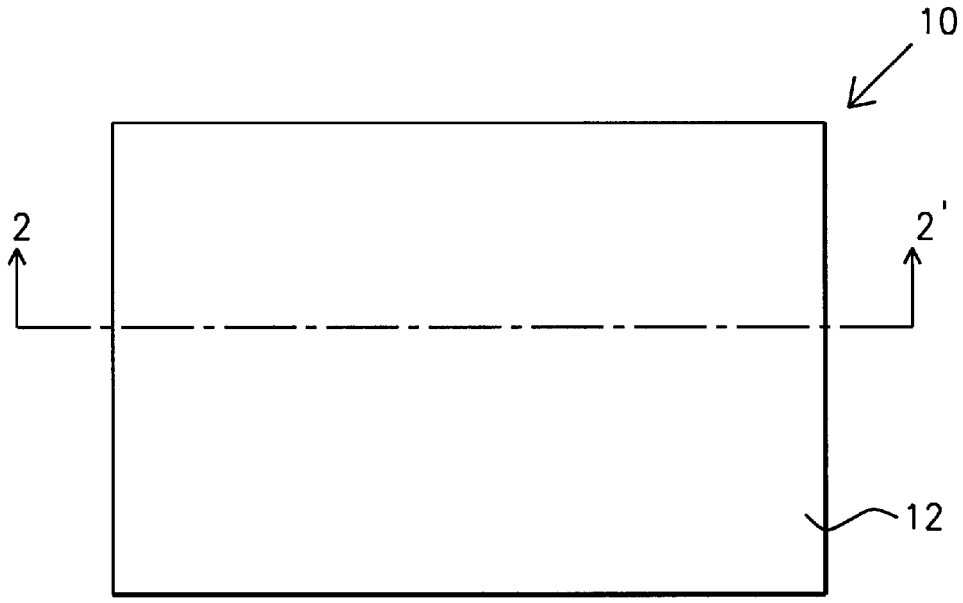
FIG. 1 shows a top view of a layer of conducting material formed on a layer of dielectric material.
Figure 2:
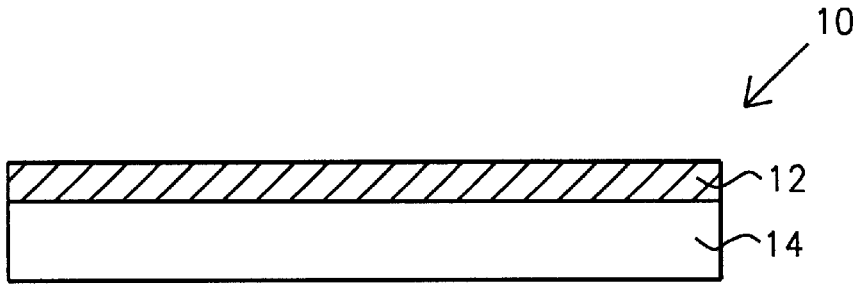
FIG. 2 shows a cross section view of the substrate blank of FIG. 1 showing the layer of conducting material formed on the top surface of the layer of dielectric material, taken along line 2–2' of FIG. 1.

Refer now to FIGS. 1–11 for a description of the preferred embodiments of the antennas of this invention. The antennas of this invention are planar antennas and are formed by etching a pattern in a layer of conducting material formed on a layer of dielectric material. FIG. 1 shows a top view of a substrate blank 10 used in forming the antennas. FIG. 2 shows a cross section view of the substrate blank 10 used in forming the antennas showing a layer of conducting material 12 formed on the top surface of a layer of dielectric material 14.

The conducting material 12 is a material such as copper, typically having a thickness of between about 0.001 and 0.005 inches. Other conducting materials such as aluminum or gold can also be used. The dielectric material typically is a material such as epoxy-glass, but other dielectric materials can also be used. Lower dielectric constant is preferred. The conducting material can be laminated on the layer of dielectric material or deposited by other means, such as evaporation or plating. The substrate blank for forming the antennas can be standard circuit board material.

Figure 3:
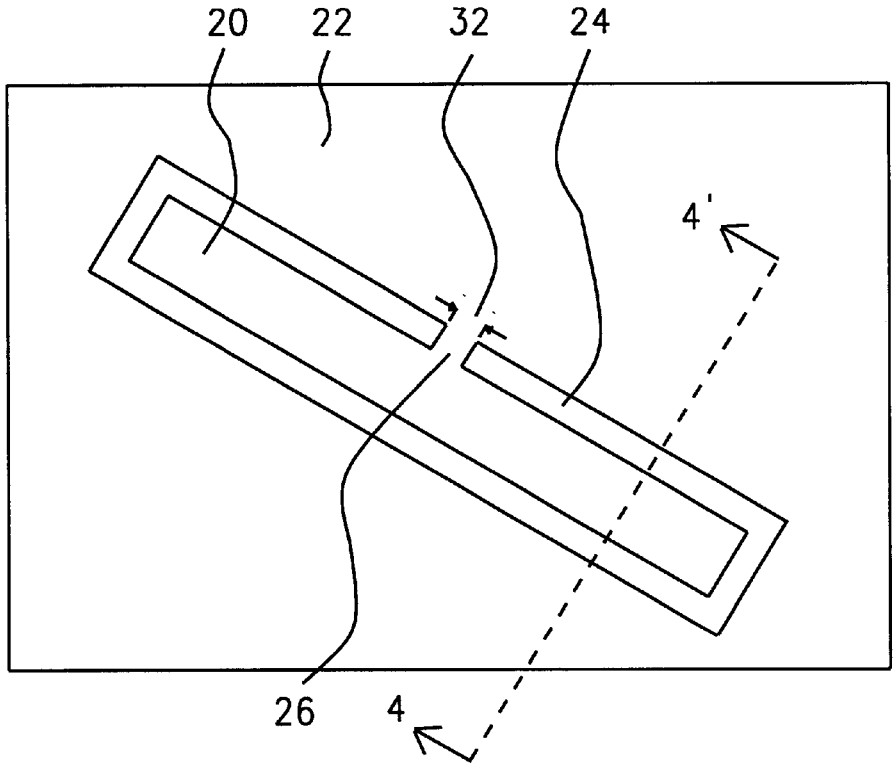
FIG. 3 shows a top view of an antenna of this invention having a rectangular first antenna element.
Figure 4:
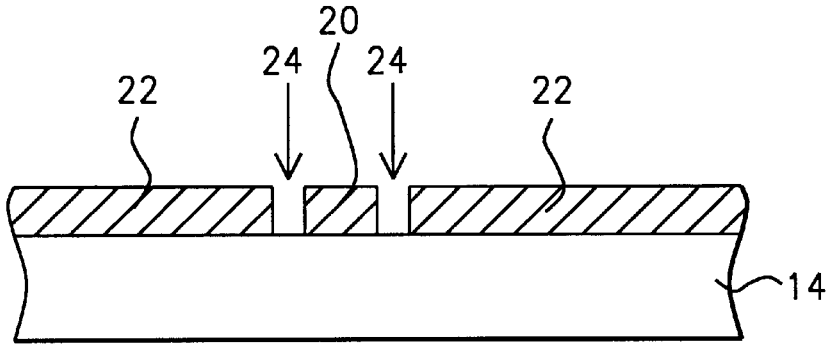
FIG. 4 shows a cross section view of the antenna of this invention having a rectangular first antenna element shown in FIG. 3 taken along line 4–4' of FIG. 3.

A preferred embodiment of the planar antenna of this invention is shown in FIGS. 3–9. FIG. 3 shows a top view of the antenna showing a rectangular first antenna element 20 surrounded by a second antenna element 22. As shown in FIG. 4, the first antenna element 20 and second antenna element 22 are formed by etching an insulating gap 24 in the layer of conducting material formed on the layer of dielectric material 14. The insulating gap 24 typically has a width of 0.05 inches, however other widths can also be used. FIG. 4 shows a cross section of the antenna shown in FIG. 3 taken along line 4–4' of FIG. 3. As shown in FIG. 3, the insulating gap 24 extends around the entire outer perimeter of the first antenna element 20 except for a shorting element 26 formed of a length 32 of conducting material. The length 32 of the shorting element 26 is typically 0.25 inches, however other lengths for the shorting element 26 can also be used. The length 32 of the shorting element is not critical as long as the electrical short is positioned properly. The shorting element connects the first antenna element 20 to the second antenna element 22.

The center frequency, or frequency of interest, of the antenna is established by the length of the outer perimeter of the first antenna element 20, which is also the length of the insulating gap 24. This length of the outer perimeter of the first antenna element 20 is equal to a multiple of one fourth of the wavelength of the center frequency of the antenna. For one key application, that of Low Earth Orbital (LEO) satellite communications, the center frequency is 145 MHz. The quarter wavelength for 145 MHz is 19.6 inches. In a typical product design for this application the dimensions of the second antenna element, reference number 22 in FIG. 3, are 18 inches by 12 inches. The total outer perimeter of the second antenna element 22, 60 inches, is approximately three one-quarter wavelengths for a center frequency of 145 MHz. In this typical product design the first antenna element 20 has a length of 19 inches and a width of 0.75 inches so that the sum of length plus the width is approximately one-quarter wavelength for a center frequency of 145 MHz. As previously indicated, center frequency 145 MHz is an example only; the antenna can be designed to higher or lower center frequencies by appropriate scaling of the dimensions.

Figure 5:
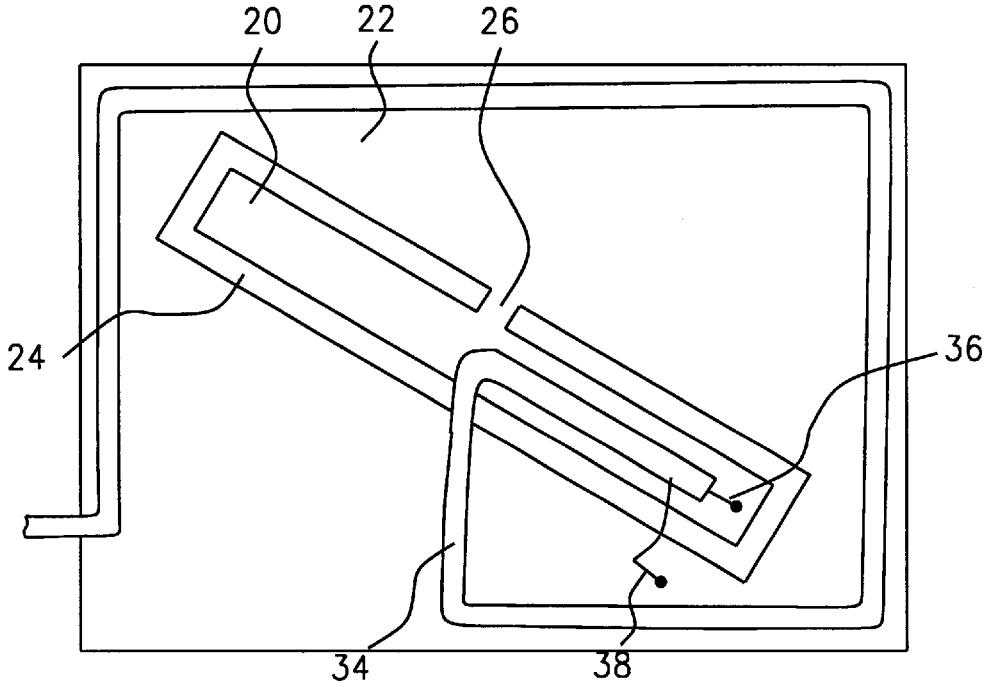
FIG. 5 shows a top view of an antenna of this invention having a rectangular first antenna element and showing the coaxial cable connection and routing.

RF Power is fed to or extracted from the antenna using a coaxial cable 34 as shown in FIG. 5. The coaxial cable 34 has its center conductor 36 connected to the first antenna element 20 and the outer conductor or shield, often electrical ground, connected to the second antenna element 22. The coaxial cable 34 is then placed around the outer perimeter of the second antenna element 22 and exited from the second antenna element surface at an integer number of one-half wavelengths of the antenna's resonant frequency, as shown in FIG. 5. The other end of the coaxial cable is connected to the transceiver, not shown. The layer of dielectric material is usually rectangular but can be nearly any shape that will encompass the etched pattern, such as oval. Conductive material is usually deposited on the top surface of the dielectric material only, see FIG. 2.

Figure 6:
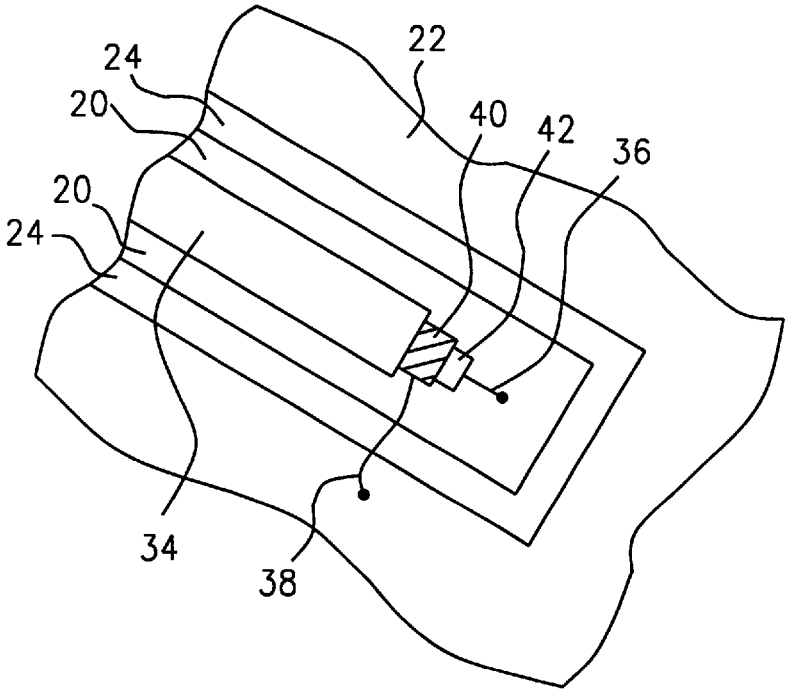
FIG. 6 shows a detail view of the coaxial cable connection to the antenna having a rectangular first antenna element shown in FIG. 5.

FIG. 6 shows the detail of the connection of the coaxial cable 34 to the antenna. The outer conductor 38 of the coaxial cable 34 is connected to the second antenna element 22. The center conductor 36 of the coaxial cable 34 is connected to the first antenna element 20. The coaxial cable 34 generally crosses the insulating gap 24 about an eighth wavelength of the center frequency of the antenna away from the point at which the center conductor 36 of the coaxial cable 34 is connected to the first antenna element 20, see FIG. 5. The point at which the coaxial cable 34 crosses the insulating gap 24 is key to the tuning of the antenna. The antenna comprises the first antenna element 20, the second antenna element 22, the insulating gap 24, the shorting element 26, and the coaxial cable 34. The coaxial cable 34 is a fixed length, an odd quarter wavelength, from the transceiver.

Figure 7:
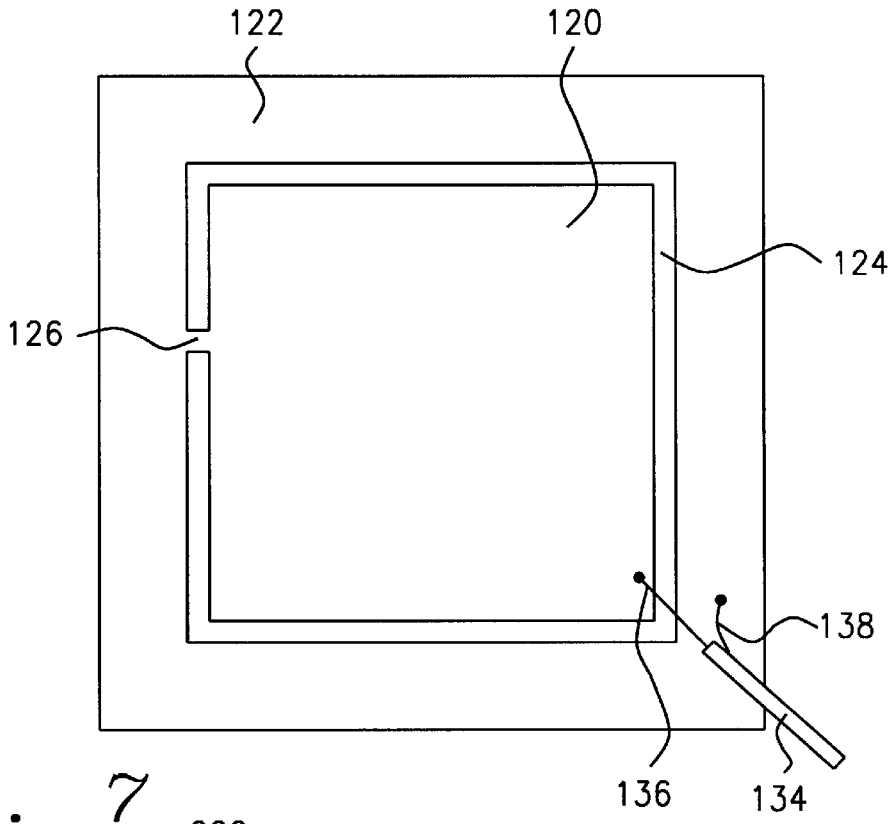
FIG. 7 shows a top view of an antenna of this invention having a square first antenna element and showing the coaxial cable connection and routing. In this case the width of the second antenna element is considerably less than a quarter wavelength of the antenna's resonance frequency. Also in this case, the length of the coaxial cable before crossing the outer edge of the second antenna element is considerably less than a half wavelength of the antenna's resonance frequency.
Figure 8:
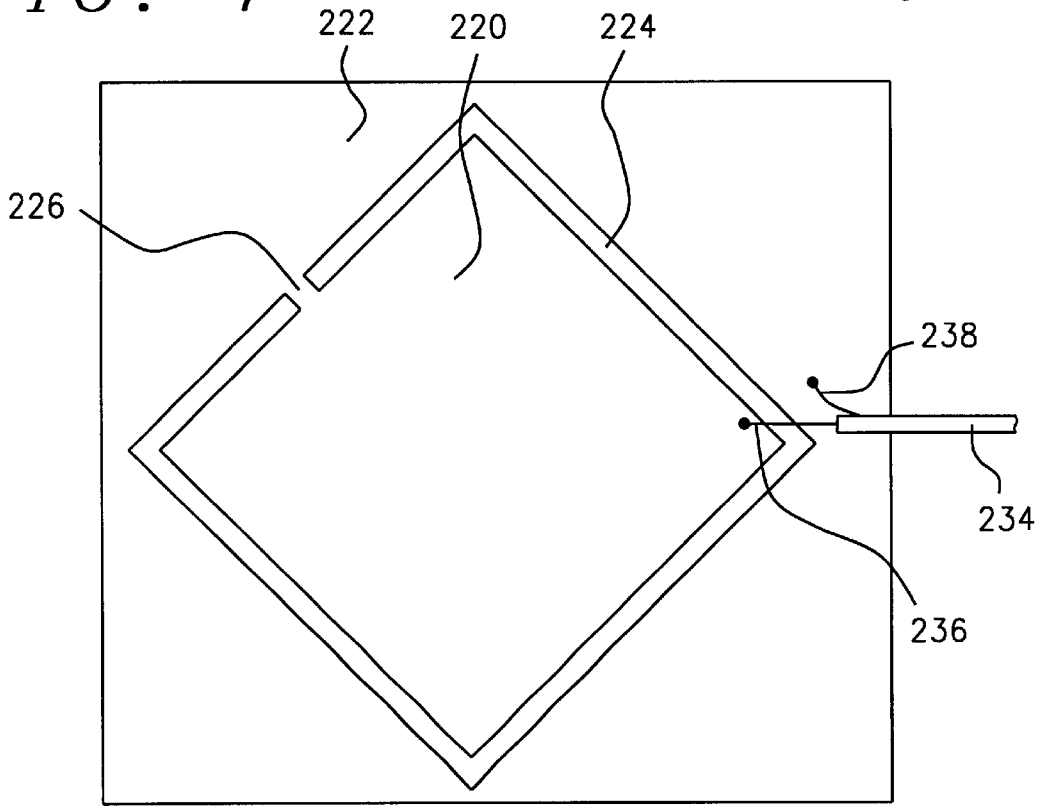
FIG. 8 shows a top view of an antenna of this invention having a rectangular first antenna element rotated 45° with respect to the layer of conducting material and showing the coaxial cable connection and routing. In this case the length of the coaxial cable at the crossing of the second antenna element is considerably less than a half wavelength of the antenna's resonance frequency.
Figure 9:
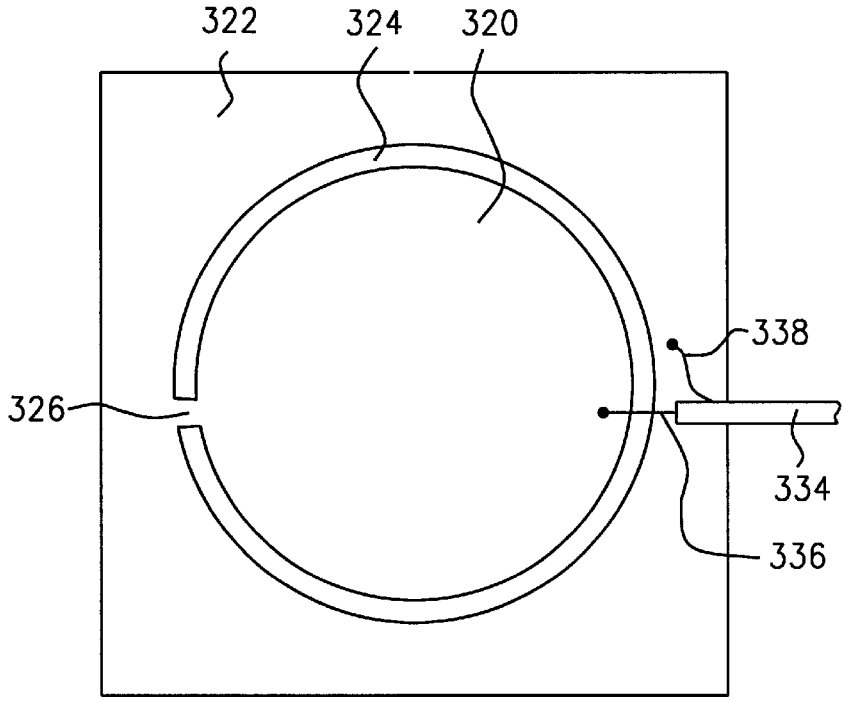
FIG. 9 shows a top view of an antenna of this invention having a circular first antenna element and showing the coaxial cable connection and routing.

As shown in FIG. 7 the first antenna element 120 can be a shape other than a narrow rectangle, such as a square, for example, having the same orientation as the second antenna element 122, with a shorting element 126 and insulating gap 124 as shown. FIG. 7 also shows the connection of the center conductor 136 of the coaxial cable 134 to the first antenna element 120 and the outer conductor 138 of the coaxial cable to the second antenna element 122. FIG. 8 shows a square first antenna element 220 rotated 450 with respect to the second antenna element 222. The shorting element 226 and the insulating gap 224 are as shown in FIG. 8. FIG. 8 also shows the connection of the center conductor 236 of the coaxial cable 234 to the first antenna element 220 and the outer conductor 238 of the coaxial cable to the second antenna element 222. Finally, as shown in FIG. 9, the first antenna element 320 can be a circle. The rectangular second antenna element 322, the shorting element 326, and the insulating gap 324 are as shown in FIG. 9. FIG. 9 also shows the connection of the center conductor 336 of the coaxial cable 334 to the first antenna element 320 and the outer conductor 338 of the coaxial cable to the second antenna element 322. In all of these examples the lengths of the perimeters of the first and second antenna elements are a multiple of the quarter wavelength of the center frequency of resonance of the antenna. In the examples shown in FIGS. 7–9 the length of the coaxial cable from the attachment of the antenna elements to the escape from the second antenna element is much less than one quarter wavelength of the antenna's center frequency. The positioning of the shorting element may vary around the structure in order to provide good impedance matching.

Figure 10:
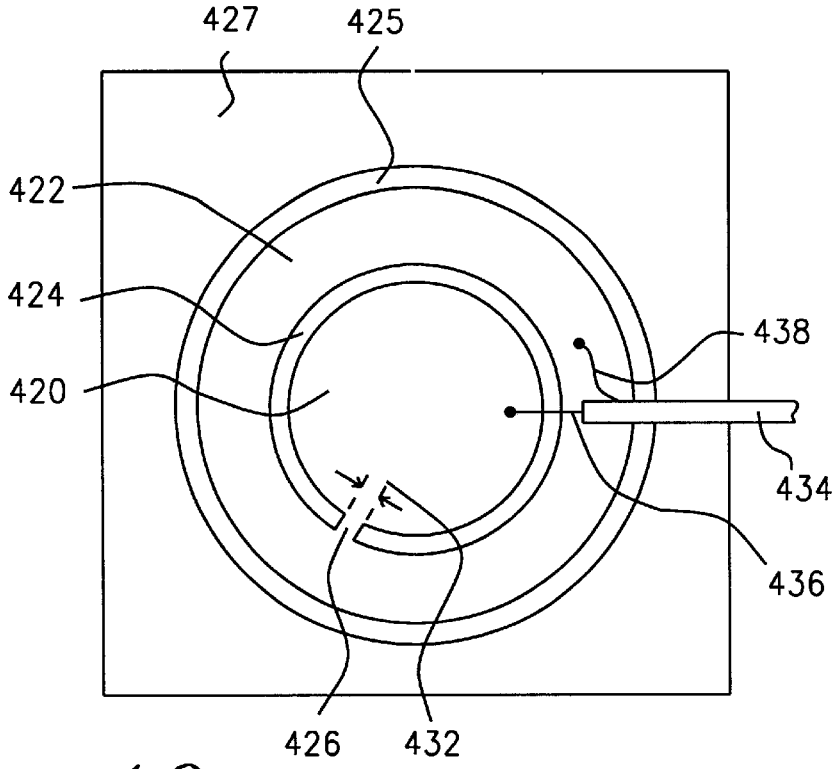
FIG. 10 shows a top view of another antenna of this invention having a circular first and second antenna elements plus showing the coaxial cable connection and routing.

Refer now to FIG. 10 for another preferred embodiment of the antenna of this invention. A first antenna element 420 and a second antenna element 422 are formed of the conducting material on the layer of dielectric material. A first insulating gap 424 separates the first antenna element 420 and the second antenna element 422 except for the shorting element 426 formed of the conducting material. For example, the first insulating gap 424 can be about 0.05 inches and the shorting element 426 can have a length 432 of about 0.075 inches but other insulating gaps and shorting element lengths will also work. The antenna comprises a first antenna element 420, a second antenna element 422, a shorting element 426, a background element 427, a first insulating gap 424, and a second insulating gap 425. The positioning of the shorting element may vary around the structure in order to provide good impedance matching.

In this embodiment the second antenna element 422 is surrounded by a background element 427 of the conducting material. The second antenna element 422 is separated from the background element 427 by a second insulating gap 425. For example the second insulating gap can have a width of about 0.05 inches but other widths can be used. FIG. 10 shows the connection of the center conductor 436 of the coaxial cable 434 to the first antenna element 420 and the outer conductor 438 of the coaxial cable to the second antenna element 422. As in the preceding embodiment, the other end of the coaxial cable 434 is connected to a transceiver, not shown.

As in the preceding embodiment, the center frequency, or frequency of interest, of the antenna is established by the length of the outer perimeter of the first antenna element 420, which is also the length of the insulating gap 424. This length of the outer perimeter of the first antenna element 420 is equal to a multiple of one quarter of the wavelength of the center resonance frequency of the antenna. In the case where the design is optimized for 145 MHz, which results in a quarter wavelength of about 20 inches, the perimeter of the first antenna element 420 will be about 20 inches.

Figure 11:
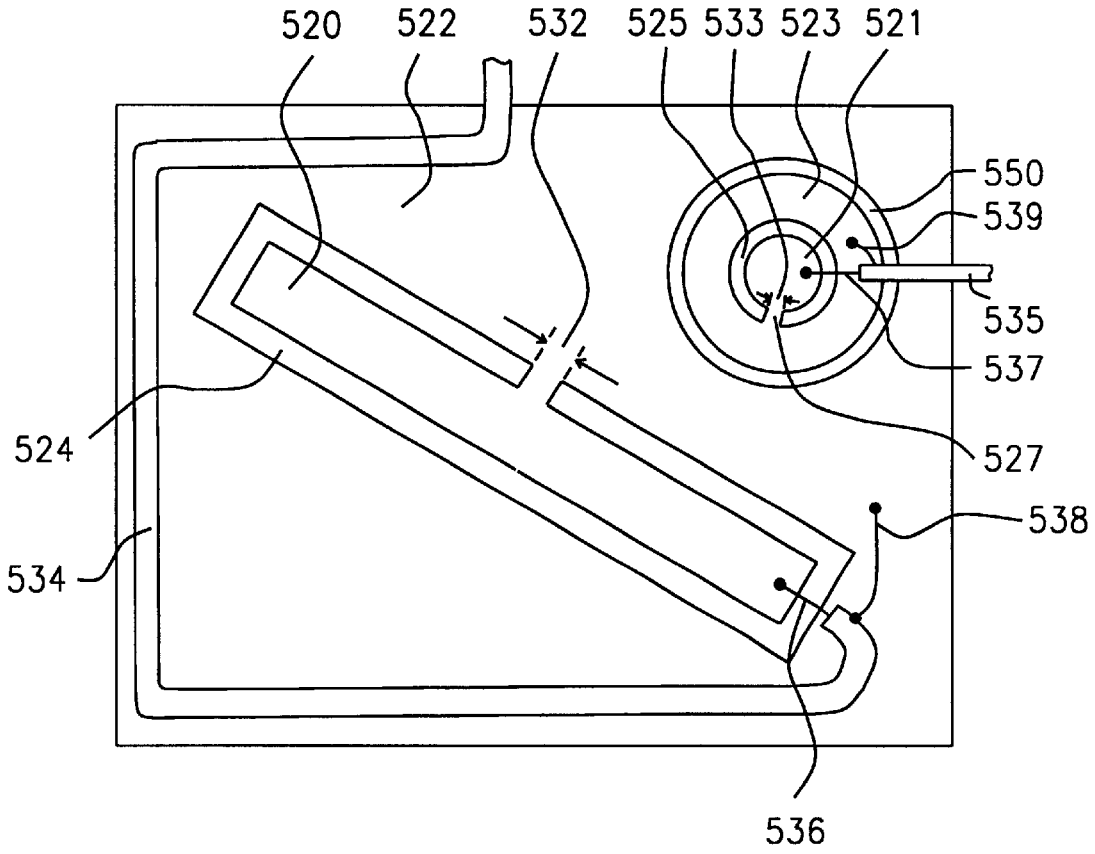
FIG. 11 shows a top view of an antenna of this invention having two antennas formed on the same layer of dielectric material, having a rectangular first antenna element for a first antenna and a circular first antenna element for a second antenna, and showing the coaxial cable connection and routing to the first antenna and to the second antenna.

Refer now to FIG. 11 for another preferred embodiment of the antenna of this invention. In this embodiment the antenna is an antenna system comprising two antennas, a first antenna and a second antenna. As shown in FIG. 11, a rectangular first antenna element 520 and a fourth antenna element 522 are formed on a layer of dielectric material by etching a first insulating gap 524 thereby separating the first antenna element 520 from the fourth antenna element 522 except for a first shorting element 526. For example, the first insulating gap 524 can have a width of about 0.05 inches and the first shorting element 526 can have a length 532 of about 0.075 inches but other insulating gap widths and shorting element lengths can be used. The first antenna comprises the first antenna element 520, the fourth antenna element 522, the first shorting element 526, and the first insulating gap 524.

As shown in FIG. 11, a circular second antenna element 521 and a third antenna element 523 are formed on the same layer of dielectric material by etching a second insulating gap 525 thereby separating the second antenna element 521 from the third antenna element 523 except for a second shorting element 527. A third insulating gap 550 separates the third antenna element 523 from the fourth antenna element 522. For example, the second insulating gap 525 can have a width of about 0.05 inches and the second shorting element 527 can have a length 532 of about 0.075 inches but other gap widths and shorting element lengths can be used. The second antenna comprises the second antenna element 521, the third antenna element 523, the second shorting element 527, and the second insulating gap 525. The length of the perimeter of the first antenna element 520 is a multiple of one quarter of the wavelength of the center resonance frequency of the first antenna. The length of the perimeter of the second antenna element 521 is a multiple of one quarter of the wavelength of the center resonance frequency of the second antenna. In the specific application that uses LEO satellites for asset tracking, the center resonance frequency of the first antenna is 145 MHz and the center resonance frequency of the second antenna is 1.57542 GHz.

RF Power is delivered to or extracted from the first antenna by a first coaxial cable 534. As shown in FIG. 11, the center conductor 536 of the first coaxial cable 534 is connected to the first antenna element 520 and the outer conductor 538 of the first coaxial cable 534 is connected to the fourth antenna element 522. Power is delivered to or extracted from the second antenna by a second coaxial cable 535. As shown in FIG. 11, the center conductor 537 of the second coaxial cable 535 is connected to the second antenna element 521 and the outer conductor 539 of the second coaxial cable 535 is connected to the third antenna element 523. The other end of the first coaxial cable 534 is connected to a first transceiver, not shown. The other end of the second coaxial cable 535 is connected to a second transceiver, not shown. As shown in FIG. 11, the coaxial cable 534 connected to the first antenna is routed around the periphery of the fourth antenna element 522 exiting the fourth antenna element at a length of a multiple of one-half wavelength of the first antenna's resonant frequency. The coaxial cable 535 connected to the second antenna exits the fourth antenna element 522 at a length of much less than one-quarter of the wavelength of the resonance frequency of the second antenna.

While the invention has been particularly shown and described with reference to the preferred embodiments thereof, it will be understood by those skilled in the art that various changes in form and details may be made without departing from the spirit and scope of the invention.

What is claimed is:

1. An antenna, comprising:

a first antenna element, having an outer perimeter, formed of a conducting material on a layer of dielectric material;

a second antenna element, having an outer perimeter, formed of said conducting material on said layer of dielectric material, wherein said second antenna element surrounds said first antenna element;

a shorting element formed of said conducting material on said layer of dielectric material, wherein said shorting element connects said first antenna element and said second antenna element;

an insulating gap, wherein said insulating gap insulates said first antenna element from said second antenna element except for the region where said shorting element connects said first antenna element and said second antenna element so that said first antenna element, said second antenna element, and said shorting element form said antenna; and a coaxial cable having an inner conductor and an outer conductor wherein said inner conductor of said coaxial cable is connected to said first antenna element and said outer conductor of said coaxial cable is connected to said second antenna element, and wherein the location of said shorting element, the location of the connection of said inner conductor of said coaxial cable to said first antenna element, and the location at which said coaxial cable exits said second antenna element are adjusted to tune the impedance of the antenna.

2. The antenna of claim 1 wherein the antenna is tuned to 50 ohms.

3. The antenna of claim 1 wherein said first antenna element is a rectangle.

4. The antenna of claim 1 wherein said first antenna element is a circle.

5. The antenna of claim 1 wherein the length of said outer perimeter of said first antenna element is about equal to an integer multiple of one quarter of the wavelength of the center frequency of resonance of said antenna.

6. The antenna of claim 1 wherein the center frequency of resonance of said antenna is 145 megahertz.

7. The antenna of claim 1 wherein the length of said outer perimeter of said second antenna element is approximately equal to an integer multiple of one quarter of the wavelength of the center frequency of resonance of said antenna.

8. The antenna of claim 1 wherein said first antenna element, said second antenna element, and said shorting element are formed by patterning a layer of said conducting material formed on said layer of dielectric material.

9. The antenna of claim 1 wherein said antenna can be used as either a transmitting antenna or a receiving antenna.

10. The antenna of claim 1 wherein said first antenna element, said second antenna element, and said shorting element are all planar and lie in a single plane.

11. An antenna, comprising:

first antenna element, having an outer perimeter, formed of a conducting material on a layer of dielectric material;

a second antenna element formed of said conducting material on said layer of dielectric material, wherein said second antenna element surrounds said first antenna element;

a background element, wherein said background element surrounds said second antenna element;

a shorting element formed of said conducting material on said layer of dielectric material, wherein said shorting element connects said first antenna element and said second antenna element;

a first insulating gap, wherein said first insulating gap insulates said first antenna element from said second antenna element except for the region where said shorting element connects said first antenna element and said second antenna element so that said first antenna element, said second antenna element, and said shorting element form said antenna;

a second insulating gap wherein said second insulating gap insulates said second antenna element from said background element; and a coaxial cable having an inner conductor and an outer conductor wherein said inner conductor of said coaxial cable is connected to said first antenna element and said outer conductor of said coaxial cable is connected to said second antenna element, and wherein the location of said shorting element, the location of said connection of said inner conductor of said coaxial cable to said first antenna element, and the location at which said coaxial cable exits said second antenna element are adjusted to tune the impedance of the antenna.

12. The antenna of claim 11 wherein the antenna is tuned to 50 ohms.

13. The antenna of claim 11 wherein said first antenna element and said second antenna elements are circles.

14. The antenna of claim 11 wherein the length of said outer perimeter of said first antenna element is equal to an integer multiple of one quarter of the wavelength of the center frequency of resonance of said antenna.

15. The antenna of claim 11 wherein the center frequency of resonance of said antenna is 145 megahertz.

16. The antenna of claim 11 wherein said first antenna element, said second antenna element, said background element, and said shorting element are formed by patterning a layer of said conducting material formed on said layer of dielectric material.

17. The antenna of claim 11 wherein said antenna can be used as either a transmitting antenna or a receiving antenna.

18. The antenna of claim 11 wherein said first antenna element, said second antenna element, said background element, and said shorting element are all planar and lie in a single plane.

19. A number of antennas, comprising:

a first antenna element, having an outer perimeter, formed of a conducting material on a layer of dielectric material;

a second antenna element, having an outer perimeter, formed of said conducting material on said layer of dielectric material;

a third antenna element formed of said conducting material on said layer of dielectric material, wherein said third antenna element surrounds said second antenna element;

a fourth antenna element formed of said conducting material on said layer of dielectric material, wherein said fourth antenna element surrounds said first antenna element and said third antenna element;

a first shorting element formed of said conducting material on said layer of dielectric material, wherein said first shorting element connects said first antenna element and said fourth antenna element;

a second shorting element formed of said conducting material on said layer of dielectric material, wherein said second shorting element connects said second antenna element and said third antenna element;

a first insulating gap, wherein said first insulating gap insulates said first antenna element from said fourth antenna element except for the region where said first shorting element connects said first antenna element and said fourth antenna element so that said first antenna element, said fourth antenna element, and said first shorting element form a first antenna;

a second insulating gap, wherein said second insulating gap insulates said second antenna element from said third antenna element except for the region where said second shorting element connects said second antenna element and said third antenna element so that said second antenna element, said third antenna element, and said second shorting element form a second antenna;

a third insulating gap wherein said third insulating gap insulates said third antenna element from said fourth antenna element;

a first coaxial cable having an inner conductor and an outer conductor, wherein said inner conductor of said first coaxial cable is connected to said first antenna element and said outer conductor of said first coaxial cable is connected to said fourth antenna element, and wherein the location of said first shorting element, the location of the connection of said inner conductor of said first coaxial cable to said first antenna element, and the location at which said first coaxial cable exits said fourth antenna element are adjusted to tune the impedance of said first antenna; and a second cable having an inner conductor and an outer conductor, wherein said inner conductor of said second coaxial cable is connected to said second antenna element and said outer conductor of said second coaxial cable is connected to said third antenna element, and wherein the location of said second shorting element, the location of the connection of said inner conductor of said second coaxial cable to said second antenna element, and the location at which said second coaxial cable exits said third antenna element are adjusted to tune the impedance of said second antenna.

20. The antennas of claim 19 wherein said first antenna and said second antenna are tuned to 50 ohms.

21. The antennas of claim 19 wherein said first antenna element is a rectangle, said second antenna element is a circle, and said third antenna element is a circle.

22. The antennas of claim 19 wherein the length of said outer perimeter of said first antenna element is equal to an integer multiple of one quarter of the wavelength of the center resonance frequency of said first antenna.

23. The antennas of claim 19 wherein the length of said outer perimeter of said second antenna element is equal to an integer multiple of one quarter of the wavelength of the center resonance frequency of said second antenna.

24. The antenna of claim 19 wherein said center resonance frequency of said first antenna is 145 megahertz.

25. The antenna of claim 19 wherein said center resonance frequency of said second antenna is 1.57542 gigahertz.

26. The antenna of claim 19 wherein said first antenna element, said second antenna element, said third antenna element, said fourth antenna element, and said shorting element are formed by patterning a layer of said conducting material formed on said layer of dielectric material.

27. The antenna of claim 19 wherein said first antenna and said second antenna can each be used as either a transmitting antenna or a receiving antenna.

28. The antenna of claim 19 wherein said first antenna element, said second antenna element, said third antenna element, said fourth antenna element, and said shorting element are all planar and lie in a single plane.

* * * * *